US008373610B2

(12) United States Patent
Chiang et al.

(10) Patent No.: US 8,373,610 B2
(45) Date of Patent: Feb. 12, 2013

(54) MICROSLOT ANTENNAS FOR ELECTRONIC DEVICES

(75) Inventors: Bing Chiang, Cupertino, CA (US); Gregory Allen Springer, Sunnyvale, CA (US); Douglas B. Kough, San Jose, CA (US); Enrique Ayala, Watsonville, CA (US); Matthew Ian McDonald, San Jose, CA (US)

(73) Assignee: Apple Inc., Cupertino, CA (US)

( * ) Notice: Subject to any disclaimer, the term of this patent is extended or adjusted under 35 U.S.C. 154(b) by 930 days.

(21) Appl. No.: 11/958,988

(22) Filed: Dec. 18, 2007

(65) Prior Publication Data

US 2009/0153409 A1 Jun. 18, 2009

(51) Int. Cl.
*H01Q 13/10* (2006.01)

(52) U.S. Cl. ..... 343/770

(58) Field of Classification Search ..... 343/767, 343/770, 771

See application file for complete search history.

(56) References Cited

U.S. PATENT DOCUMENTS

| | | | | |
|---|---|---|---|---|
| 5,489,913 | A * | 2/1996 | Raguenet et al. | 343/767 |
| 6,369,771 | B1 | 4/2002 | Chiang et al. | |
| 6,670,923 | B1 | 12/2003 | Kadambi et al. | |
| 6,741,214 | B1 | 5/2004 | Kadambi et al. | |
| 6,747,601 | B2 | 6/2004 | Boyle | |
| 6,774,852 | B2 | 8/2004 | Chiang et al. | |
| 6,856,294 | B2 | 2/2005 | Kadambi et al. | |
| 6,888,510 | B2 | 5/2005 | Jo et al. | |
| 6,980,154 | B2 | 12/2005 | Vance et al. | |
| 7,027,838 | B2 | 4/2006 | Zhou et al. | |
| 7,116,267 | B2 | 10/2006 | Lee | |
| 7,119,747 | B2 | 10/2006 | Lin et al. | |
| 7,123,208 | B2 | 10/2006 | Baliarda et al. | |
| 7,239,290 | B2 | 7/2007 | Poilasne et al. | |
| 7,397,439 | B2 * | 7/2008 | Kanno et al. | 343/767 |
| 2003/0107518 | A1 | 6/2003 | Li et al. | |
| 2004/0056812 | A1 * | 3/2004 | Sabet et al. | 343/725 |
| 2004/0145521 | A1 | 7/2004 | Hebron et al. | |
| 2005/0017914 | A1 * | 1/2005 | Huang | 343/770 |
| 2005/0146475 | A1 * | 7/2005 | Bettner et al. | 343/767 |
| 2005/0200545 | A1 * | 9/2005 | Bancroft | 343/770 |
| 2006/0055606 | A1 | 3/2006 | Boyle | |
| 2006/0284778 | A1 * | 12/2006 | Sanford et al. | 343/770 |

OTHER PUBLICATIONS

Hill et al. U.S. Appl. No. 11/650,187, filed Jan. 4, 2007.
Hill et al. U.S. Appl. No. 11/821,192, filed Jun. 21, 2007.
Hill et al. U.S. Appl. No. 11/897,033, filed Aug. 28, 2007.
Zhang et al. U.S. Appl. No. 11/895,053, filed Aug. 22, 2007.
Chiang et al. U.S. Appl. No. 11/702,039, filed Feb. 1, 2007.
R. Bancroft "A Commercial Perspective on the Development and Integration of an 802.11a/b/g HiperLan/WLAN Antenna into Laptop Computers", IEEE Antennas and Propagation Magazine, vol. 48, No. 4, Aug. 2006, pp. 12-18. B. Chiang et al. "Invasion of Inductor and Capacitor Chips in the Design of Antennas and Platform Integration", IEEE International Conference on Portable Information Devices, May 2007, pp. 1-4.
A. Lai et al. "Infinite Wavelength Resonant Antennas With Monopolar Radiation Pattern Based on Periodic Structures", IEEE Transactions on Antennas and Propagation, vol. 55, No. 3, Mar. 2007, pp. 868-876.

* cited by examiner

*Primary Examiner* — Robert Karacsony
(74) *Attorney, Agent, or Firm* — Treyz Law Group; G. Victor Treyz; David C. Kellogg

(57) ABSTRACT

Microslot antennas may be provided for electronic devices such as portable electronic devices. The microslot antennas may have dielectric-filled microslots that are formed in a ground plane element. The ground plane element may be formed from part of a conductive device housing. The microslots may be narrow enough that they are not readily noticeable to the naked eye. The microslots may have lengths that allow the microslot antenna to provide antenna coverage in one or more communications bands. A first group of the microslots may be used to provide coverage in a first communications band and a second group of the microslots may be used to provide coverage in a second communications band.

18 Claims, 8 Drawing Sheets

MICROSLOT ANTENNAS FOR ELECTRONIC DEVICES

BACKGROUND

This invention relates to antennas, and more particularly, to antennas for electronic devices such as portable electronic devices.

Due in part to their mobile nature, portable electronic devices are often provided with wireless communications capabilities. Portable electronic devices may use wireless communications to communicate with wireless base stations. For example, cellular telephones may communicate using cellular telephone bands at 850 MHz, 900 MHz, 1800 MHz, and 1900 MHz (e.g., the main Global System for Mobile Communications or GSM cellular telephone bands). Portable electronic devices may also use other types of communications links. For example, portable electronic devices may communicate using the Wi-Fi® (IEEE 802.11) bands at 2.4 GHz and 5.0 GHz and the Bluetooth® band at 2.4 GHz. Communications are also possible in data service bands such as the 3G data communications band at 2100 MHz band (commonly referred to as UMTS or Universal Mobile Telecommunications System).

To satisfy consumer demand for small form factor wireless devices, manufacturers are continually striving to reduce the size of components that are used in these devices. For example, manufacturers have made attempts to miniaturize the antennas used in portable electronic devices.

A typical antenna may be fabricated by patterning a metal layer on a circuit board substrate or may be formed from a sheet of thin metal using a foil stamping process. These techniques can be used to produce antennas that fit within the tight confines of a compact portable device such as a handheld electronic device. With conventional portable electronic devices, however, design compromises are made to accommodate compact antennas. These design compromises may include, for example, compromises related to antenna efficiency and antenna bandwidth.

It would therefore be desirable to be able to provide improved antennas for electronic devices such as portable electronic devices.

SUMMARY

Microslot antennas may be provided for electronic devices such as portable electronic devices. The microslot antennas may have dielectric-filled openings that are formed in a ground plane element. The dielectric-filled openings may be filled with air, plastic, epoxy, or other dielectrics.

The dielectric-filled openings may form microslots having relatively narrow widths. As an example, microslots may be used for the microslot antennas that have widths that are so narrow that the microslots are invisible to the naked eye.

The ground plane element may be formed from a conductor on a printed circuit board or other suitable conductive structure. With one suitable arrangement, the ground plane element may be formed from a conductive housing for an electronic device.

The electronic device may be a portable electronic device such as a portable computer or a handheld electronic device. By forming the microslots of the microslot antenna within the housing of the device, the need for potentially unsightly dielectric antenna covers and external antenna arrangements can be eliminated.

The microslots may have lengths that allow a microslot antenna to provide antenna coverage in one or more communications bands. In a dual-band configuration, a first group of the microslots may be used to provide coverage in a first communications band and a second group of the microslots may be used to provide coverage in a second communications band.

Further features of the invention, its nature and various advantages will be more apparent from the accompanying drawings and the following detailed description of the preferred embodiments.

DETAILED DESCRIPTION

The present invention relates generally to electronic devices, and more particularly, to antennas for wireless electronic devices.

The wireless electronic devices may be any suitable electronic devices. As an example, the wireless electronic devices may be desktop computers or other computer equipment. The wireless electronic devices may also be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, the portable electronic devices may be handheld electronic devices.

Examples of portable and handheld electronic devices include cellular telephones, media players with wireless communications capabilities, handheld computers (also sometimes called personal digital assistants), remote controls, global positioning system (GPS) devices, and handheld gaming devices. The devices may also be hybrid devices that combine the functionality of multiple conventional devices. Examples of hybrid devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
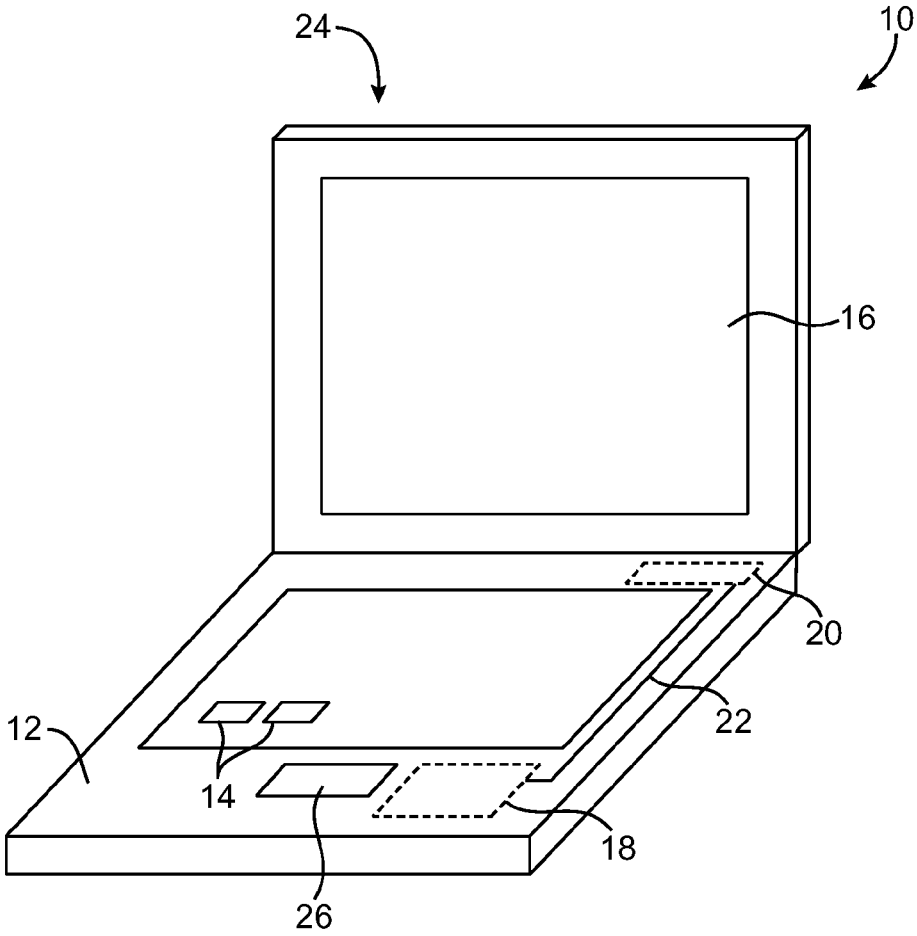
FIG. 1 is a perspective view of an illustrative electronic device such as a portable electronic device in accordance with an embodiment of the present invention.

An illustrative electronic device such as a portable electronic device in accordance with an embodiment of the present invention is shown in FIG. 1. Device 10 may be any suitable electronic device. As an example, device 10 may be a laptop computer.

Device 10 may handle communications over one or more communications bands. For example, wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5.0 GHz band that is sometimes used for Wi-Fi communications, the 1575 MHz Global Positioning System band, and 3G data bands (e.g., the UMTS band at 1920-2170). These bands may be covered by using single and multiband antennas. For example, cellular telephone communications can be handled using a multiband cellular telephone antenna and local area network data communications can be handled using a multiband wireless local area network antenna. As another example, device 10 may have a single multiband antenna for handling communications in two or more data bands (e.g., at 2.4 GHz and at 5.0 GHz).

Device 10 may have housing 12. Housing 12, which is sometimes referred to as a case, may be formed of any suitable materials including plastic, glass, ceramics, metal, other suitable materials, or a combination of these materials. In some situations, housing 12 or portions of housing 12 may be formed from a dielectric or other low-conductivity material, so as not to disturb the operation of conductive antenna elements that are located in proximity to housing 12.

Housing 12 or portions of housing 12 may also be formed from conductive materials such as metal. An illustrative metal housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 and metal components in housing 12 may be shorted together to form a ground plane in device 10 or to expand a ground plane structure that is formed from a planar circuit structure such as a printed circuit board structure (e.g., a printed circuit board structure used in forming antenna structures for device 10).

Device 10 may have one or more buttons such as buttons 14. Buttons 14 may be formed on any suitable surface of device 10. In the example of FIG. 1, buttons 14 have been formed on the top surface of device 10. Buttons 14 may form a keyboard on a laptop computer (as an example).

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality may be integrated into display 16. Device 10 may also have a separate touch pad device such as touch pad 26. An advantage of integrating a touch screen into display 16 to make display 16 touch sensitive is that this type of arrangement can save space and reduce visual clutter. Buttons 14 may, if desired, be arranged adjacent to display 16. With this type of arrangement, the buttons may be aligned with on-screen options that are presented on display 16. A user may press a desired button to select a corresponding one of the displayed options.

Device 10 may have circuitry 18. Circuitry 18 may include storage, processing circuitry, and input-output components. Wireless transceiver circuitry in circuitry 18 may be used to transmit and receive radio-frequency (RF) signals. Transmission lines such as coaxial transmission lines and microstrip transmission lines may be used to convey radio-frequency signals between transceiver circuitry and antenna structures in device 10. As shown in FIG. 1, for example, transmission line 22 may be used to convey signals between antenna structure 20 and circuitry 18. Transmission line 22 may be, for example, a coaxial cable that is connected between an RF transceiver (sometimes called a radio) and a multiband antenna. Antenna structures such as antenna structure 20 may be located adjacent to keys 14 as shown in FIG. 1 or in other suitable locations (e.g., on top surface 24 of housing 12).

Figure 2:
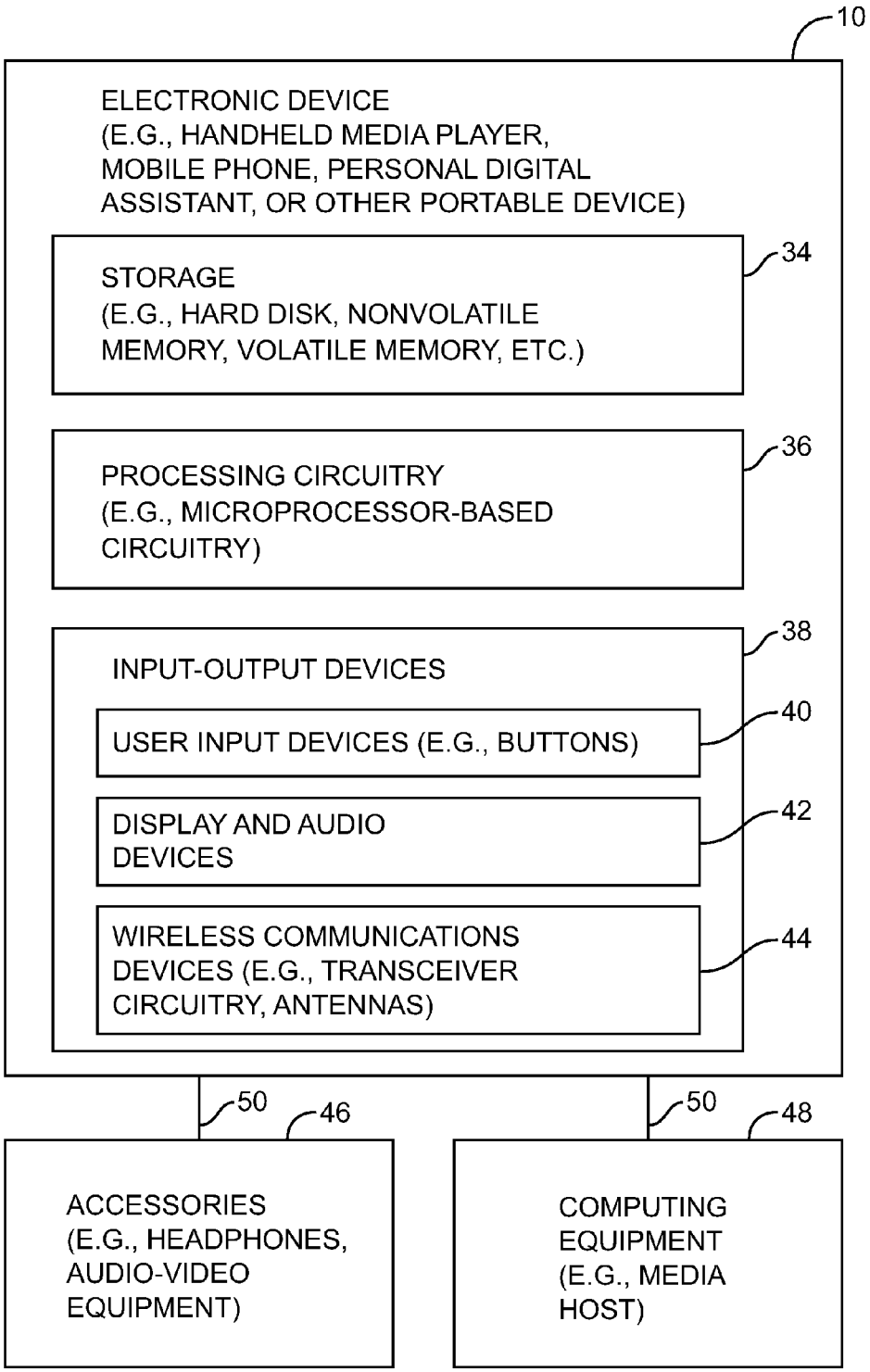
FIG. 2 is a schematic diagram of an illustrative electronic device in accordance with an embodiment of the present invention.

A schematic diagram of an embodiment of an illustrative electronic device such as a portable electronic device is shown in FIG. 2. Portable device 10 may be a notebook computer, a mobile telephone, a mobile telephone with media player capabilities, a handheld computer, a remote control, a game player, a global positioning system (GPS) device, a combination of such devices, or any other suitable portable or handheld electronic device.

As shown in FIG. 2, portable device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services such as UMTS, cellular telephone communications protocols, etc.

Input-output devices 38 may be used to allow data to be supplied to device 10 and to allow data to be provided from device 10 to external devices. Display screen 16, keys 14, and touchpad 26 of FIG. 1 are examples of input-output devices 38.

Input-output devices 38 may include user input-output devices 40 such as buttons, touch screens, joysticks, click wheels, scrolling wheels, touch pads, key pads, keyboards, microphones, cameras, speakers, tone generators, vibrating elements, etc. A user can control the operation of device 10 by supplying commands through user input devices 40.

Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas (e.g., antenna structures such as antenna structures 20 of FIG. 1), and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point or an internal or external wireless card that establishes a wireless connection with device 10. The computer may be a server (e.g., an internet server), a local area network computer with or without internet access, a user's own personal computer, a peer device (e.g., another portable electronic device 10), or any other suitable computing equipment.

The antenna structures and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2100 MHz band (commonly referred to as UMTS or Universal Mobile Telecommunications System), Wi-Fi® (IEEE 802.11) bands (also sometimes referred to as wireless local area network or WLAN bands), the Bluetooth® band at 2.4 GHz, and the global positioning system (GPS) band at 1575 MHz. Wi-Fi bands that may be supported include the 2.4 GHz band and the 5.0 GHz bands. The 2.4 GHz Wi-Fi band extends from 2.412 to 2.484 GHz. Commonly-used channels in the 5.0 GHz Wi-Fi band extend from 5.15-5.85 GHz, so the 5.0 GHz band is sometimes referred to by the 5.4 GHz approximate center frequency for this range (i.e., these communications frequencies are sometimes referred to as making up a 5.4 GHz communications band). Device 10 can cover these communications bands and/or other suitable communications bands with proper configuration of the antenna structures in wireless communications circuitry 44.

Figure 3:
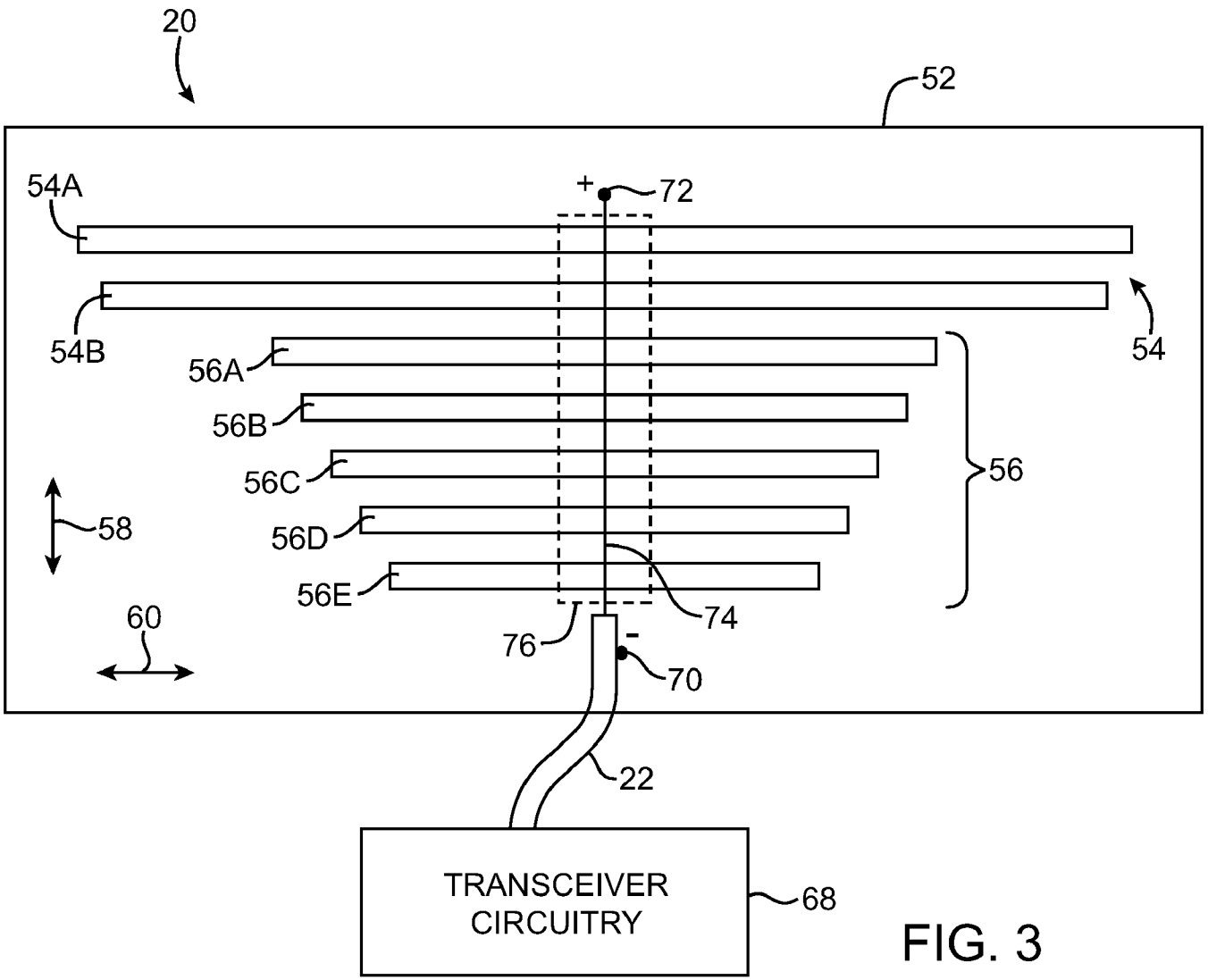
FIG. 3 is a top view of an illustrative microslot antenna in accordance with an embodiment of the present invention.

A top view of illustrative antenna structures in accordance with an embodiment of the present invention is shown in FIG. 3. As shown in FIG. 3, antenna 20 may be formed from a ground plane structure such as ground plane 52. Antenna resonating elements for antenna 20 may be formed from openings in ground plane such as openings 54 and 56. These openings, which are sometimes referred to as slots or microslots, may be filled with air or other suitable dielectrics such as plastic or epoxy. Microslots 54 and 56 may be substantially rectangular in shape and may have narrower dimensions (i.e., widths measured parallel to lateral dimension 58) and longer dimensions (e.g., lengths measured parallel to longitudinal dimension 60). If desired, microslots 54 and 56 may also have non-rectangular shapes (e.g., shapes with non-perpendicular edges, shapes with curved edges, shapes with bends, etc.). The use of rectangular microslot configurations is generally described herein as an example.

The widths of microslots 54 and 56 are generally much less than their lengths. For example, the widths of microslots 54 and 56 may be on the order of microns, tens of microns, or hundreds of microns (e.g., 5-200 microns, 10-30 microns, less than 100 microns, less than 50 microns, less than 30 microns, etc.), whereas the lengths of microslots 54 and 56 may be on the order of millimeters or centimeters (e.g., 10 mm or more). With one suitable arrangement, the lengths of microslots 54 and 56 may be selected so that the microslots form antenna resonances at desired operating frequencies. The lengths of microslots 54 and 56 may, for example, be adjusted to be equal to a half of a wavelength at a desired operating frequency (for slots that are closed at both ends) or equal to a quarter of a wavelength (for slot structures that are open at one end). The spacing between respective microslots may be, for example, on the order of microns to millimeters.

Ground plane 52 may be formed from a printed circuit board, a planar metal structure, conductive electrical components, conductive housing walls, other suitable conductive structures, or combinations of these structures. A printed circuit board substrate that is used for all or part of ground plane 52 may be rigid or flexible. An example of a rigid circuit board substrate is the dielectric sometimes referred to as FR4. An example of a flexible printed circuit board material is polyimide. Flexible printed circuits are sometimes referred to as flex circuits and may be mounted to dielectric support structures such as plastic supports.

Although antennas such as microslot antenna 20 of FIG. 3 may be formed from printed circuit board structures, it may be advantageous to form antennas such as antenna 20 from conductive housing structures. With this type of arrangement, it is possible to integrate an antenna into housing 12.

Because microslots such as microslots 56 and 58 are typically narrow (e.g., 10-30 microns), the microslots in antenna 20 may be invisible to the naked eye or may at least be barely noticeable under normal observation. This allows microslot antenna 20 to be formed on normally exposed portions of housing 12. Examples of normally exposed housing portions include the exterior surfaces of a laptop computer or other device 10, surfaces of a laptop computer such as the housing surface adjacent to the keyboard or display (e.g., when the cover of a laptop computer has been opened for use), or housing sidewalls. When antenna 20 is formed on an exterior surface of device 10, antenna 20 will not generally be blocked by surrounding conductive materials (e.g., conductive housing walls). This allows antenna 20 to operate freely without requiring the formation of potentially unsightly and structurally weak dielectric windows (antenna caps) in device 10.

The microslots of a microslot antenna may be filled with a dielectric such as epoxy to prevent intrusion of liquids, dust, or other foreign matter. This type of filling arrangement may be particularly advantageous in situations in which antenna 20 is formed on a metal wall or other exterior surface of housing 12 where antenna 20 is exposed to the environment.

Microslots may be formed in ground plane 52 using any suitable technique. For example, when ground plane 52 is formed from a printed circuit board substrate, microslots may be formed by patterning a conductive layer on the printed circuit board using wet or dry chemical etching (as examples). Other techniques may be used when forming microslots in conductive housing walls. For example, microslots may be machined in metal walls or other conductive wall structures in housing 12 using laser cutting, plasma arc cutting, micromachining (e.g., using grinding tools), or any other suitable techniques.

Microslots may be formed in housing 12 (or other suitable ground plane elements 52) before such structures are assembled to form device 10 or after device 10 has been assembled. Microslots are typically formed for antenna 20 after housing walls 12 have been formed, but before the other components of device 10 have been mounted in housing 12.

The microslots in antenna 20 such as microslots 54 and 56 serve as antenna resonating elements for antenna 20, whereas ground plane 52 serves as a ground plane element for antenna 20. The microslots and ground plane are sometimes referred to as forming "poles" for antenna 20. Each microslot may form a respective first pole in a pair of antenna poles, whereas ground plane 52 may serve as the second pole in that pair of antenna poles.

There may be any suitable number of microslots in an antenna such as antenna 20 of FIG. 3. For example, antenna 20 may include two or more microslots having two or more respective lengths. This type of arrangement may be used to provide coverage in one or more communications bands. In a typical arrangement, the length of each microslot may be selected to adjust its resonant frequency. In this way, the frequency coverage of antenna 20 may be configured to coincide with one or more communications bands of interest.

If desired, the lengths of the microslots may be selected so that one group of microslots provides coverage in a first communications band, another group of microslots provides coverage in a second communications band, and optional additional groups of microslots provide coverage in respective additional communications bands. The lengths of the microslots may also be selected to provide coverage in only a single band (as an example).

In the example of FIG. 3, slots 54 form a first group of microslots. This group of slots includes slot 54A and slot 54B. The lengths of slots 54A and 54B may be slightly different, so that each slot provides coverage at a slightly different frequency (i.e., each slot's length may be equal to a half of a wavelength at a slightly different frequency). Microslots 56 form a second group of microslots. With the illustrative example of FIG. 3, there are five microslots in slot group 56 (i.e., microslots 56A, 56B, 56C, 56D, and 56E). Microslots 56A, 56B, 56C, 56D, and 56E may each have a different length to collectively provide coverage over a range of frequencies.

Figure 4:
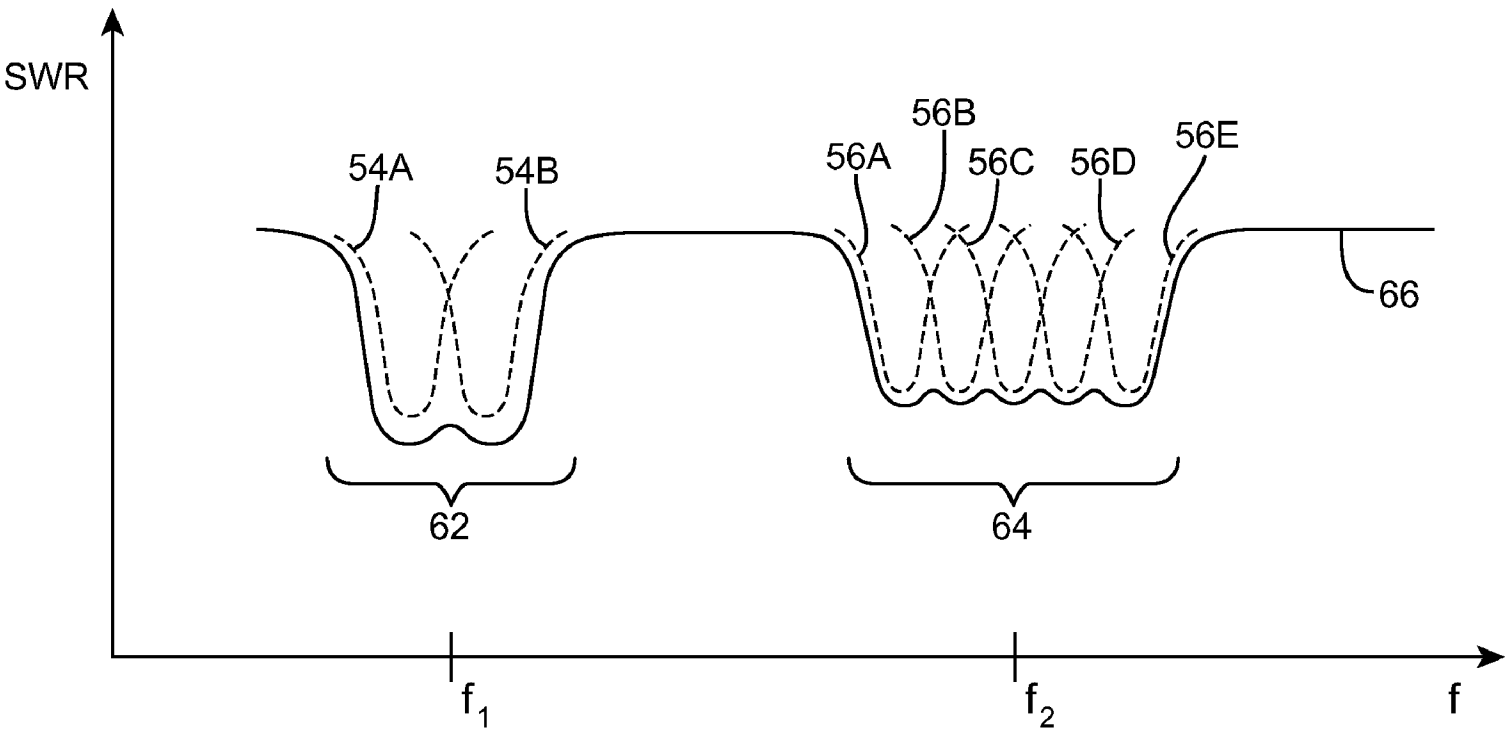
FIG. 4 is a graph showing the performance of an illustrative dual-band microslot antenna in which multiple microslots of similar length have been used to broaden coverage bandwidth in each of the two bands in accordance with an embodiment of the present invention.

An illustrative performance graph for an antenna such as antenna 20 of FIG. 3 is shown in FIG. 4. As shown in FIG. 4, antenna 20 may be used to cover two communications bands. A first of the two communications bands may be located at frequency f1 and the other of the two communications bands communications frequency may be located at f2. The first band may be (for example) the 2.4 GHz IEEE 802.11 band and the second band may be (for example) the 5.0 GHz IEEE 802.11 band (sometimes referred to by its approximate center frequency of 5.4 GHz).

The frequency response of microslot 54A of FIG. 3 is given by dashed line 54A in FIG. 4. The frequency response of microslot 54B of FIG. 3 is given by dashed line 54B in FIG. 4. Collectively, microslots 54A and 54B of microslot group 54 (FIG. 3) may produce the frequency response given by portion 62 of line 66. This frequency response may cover one or more communications channels associated with the first communications band. The use of multiple microslots (i.e., two microslots 54 in this example) may help to broaden the frequency coverage of antenna 20 in the first communications band.

The microslots in microslot group 56 collectively serve to provide frequency coverage for the second communications band. The frequency response of microslot 56A of FIG. 3 is given by dashed line 56A in FIG. 4. The frequency response of microslot 56B of FIG. 3 is given by dashed line 56B in FIG. 4. Similarly, the frequency responses of microslots 56C, 56D, and 56E of FIG. 3 are given by respective dashed lines 56C, 56D, and 56E in FIG. 4. Collectively, the microslots of microslot group 56 (FIG. 3) may produce the frequency response given by portion 64 of line 66 in FIG. 4.

As this example demonstrates, the use of multiple microslots may help to broaden the frequency coverage of antenna 20 in each communications band of operation. For example, microslots 54A and 54B may provide a greater antenna bandwidth in the vicinity of frequency f1 than would be possible using only microslot 54A or 54B independently. Similarly, microslots 56A, 56B, 56C, 56D, and 56E may provide a greater antenna bandwidth at frequency f2 than would be possible using only a subset of these microslots.

Any suitable feed arrangement may be used to feed antenna 20. As shown schematically in the example of FIG. 3, a transmission line such as transmission line 22 may be used to convey radio-frequency signals between antenna 20 and radio-frequency transceiver circuitry such as radio-frequency transceiver circuitry 68. Transceiver circuitry 68 may include one or more transceivers for handling communications in one or more discrete communications bands. For example, transceiver circuitry 68 may be used to handle communications in 2.4 GHz and 5.4 GHz communications bands. Transceiver circuitry 68 may include a diplexer or other suitable circuitry for combining the signals associated with multiple individual transceivers. For example, transceiver circuitry 68 may include a 2.4 GHz transceiver, a 5.0 GHz transceiver, and a diplexer that allows the 2.4 GHz and 5.0 GHz transceivers to be connected to a common transmission line 22.

Transmission line 22 may be coupled to antenna 20 at feed terminals such as feed terminals 70 and 72. Feed terminal 70 may be referred to as a ground or negative feed terminal and may be shorted to the outer (ground) conductor of transmission line 22. Feed terminal 72 may be referred to as the positive antenna terminal. Transmission line center conductor 74 may be used to connect transmission line 22 to positive feed terminal 72. If desired, other types of antenna coupling arrangements may be used (e.g., based on near-field coupling, using impedance matching networks, etc.).

As shown schematically by dashed line 76 in FIG. 3, the feed arrangement for antenna 20 may include a matching network. Matching network 76 may include a balun (to match an unbalanced transmission line to a balanced antenna) and/or an impedance transformer (to help match the impedance of the transmission line to the impedance of the antenna).

Figure 5:
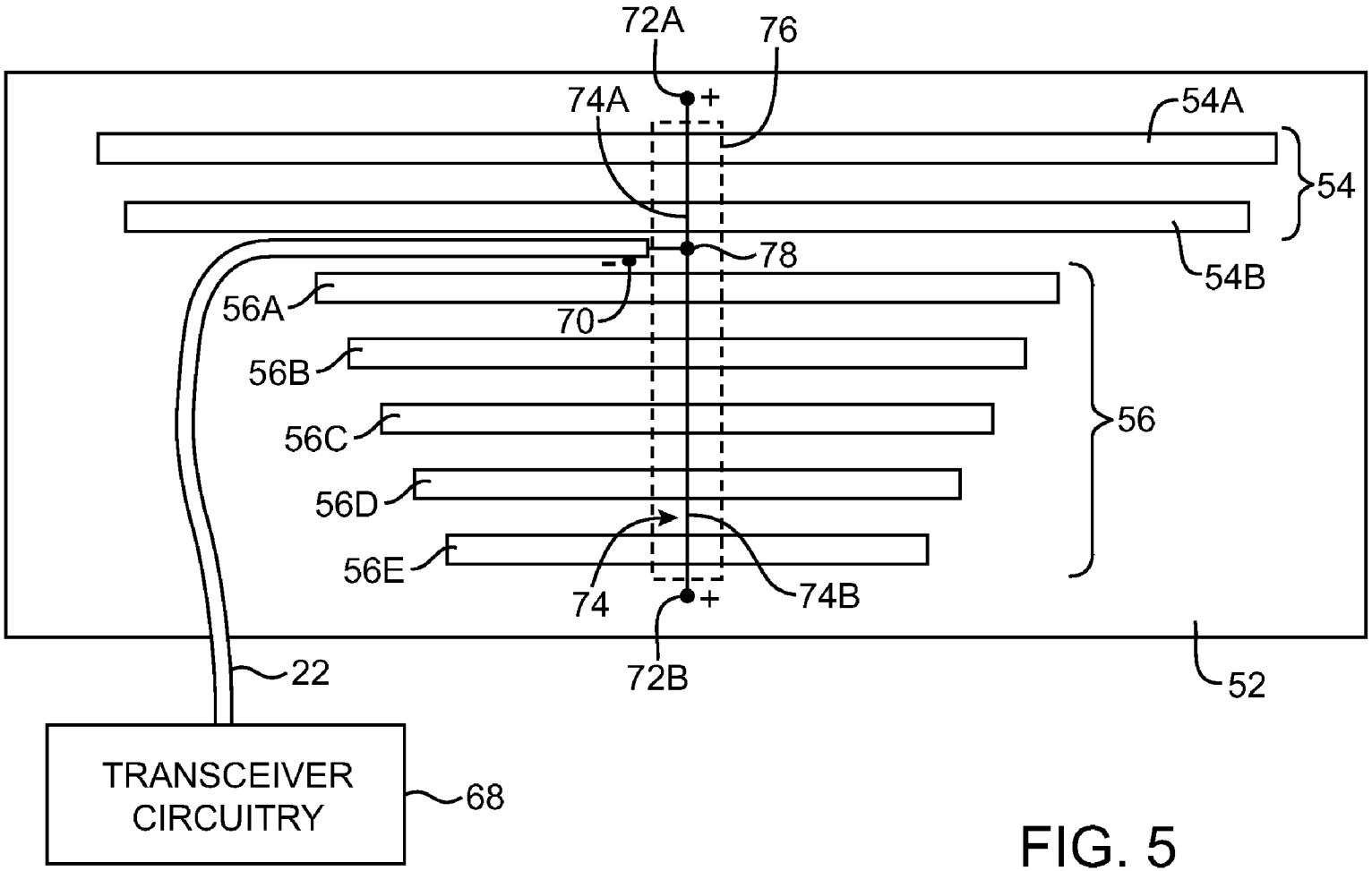
FIG. 5 is a top view of an alternative feed arrangement that may be used for a microslot antenna in accordance with an embodiment of the present invention.

If desired, microslot antennas such as antenna 20 may be fed using different arrangements. In the example of FIG. 5, antenna 20 is being fed from a central location. In the configuration of FIG. 5, antenna ground terminal 70 is connected to ground plane 52 at a position that is located between microslots 54 and 56. As a result, some of the microslots (i.e., microslots 54A and 54B in this example) are located on one side of ground terminal 70 and other microslots (i.e., microslots 56A, 56B, 56C, 56D, and 56E) are located on the other side of ground terminal 70. Signal conductor 74 may be split into two conductive paths at point 78. Conductive branch 74A may be connected between point 78 and first positive antenna feed terminal 72A. Conductive branch 74B may be connected between point 78 and second positive antenna feed terminal 72B.

Although antenna feed terminal 70 is located between the microslots of microslot group 54 and the microslots of microslot group 56 in the FIG. 5 example, this is merely illustrative. Antenna feed terminal 70 may be located between any two adjacent microslots in antenna 20 if desired.

The coupling efficiency between transmission line 22 and the microslots of antenna 20 may be greatest for the microslots nearest the positive antenna feed terminal(s). The use of different feed arrangements for feeding microslot antenna 20 may therefore result in different coupling efficiencies for the individual microslot elements in the antenna. This effect is illustrated in the graphs of FIGS. 6 and FIG. 7.

Figure 6:
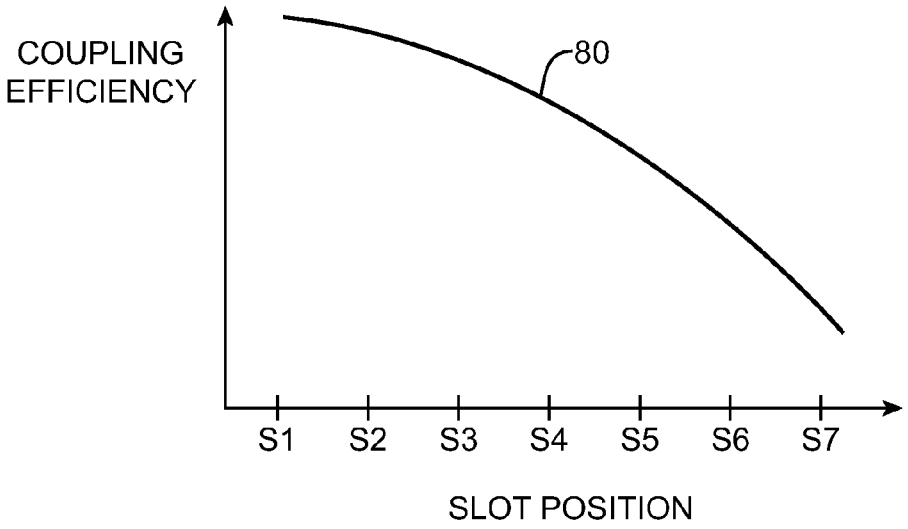
FIG. 6 is a graph showing how coupling efficiency may vary as a function of microslot position in a microslot antenna having an antenna feed arrangement of the type shown in FIG. 3 in accordance with an embodiment of the present invention.

In the graph of FIG. 6, antenna coupling efficiency is plotted as a function of slot position for an antenna feed arrangement of the type shown in FIG. 3. In this illustrative arrangement, microslot 54A is located in slot position S1, microslot 54B is located in slot position S2, microslot 56A is located in slot position S3, microslot 56B is located in slot position S4, microslot 56C is located in slot position S5, microslot 56D is located in slot position S6, and microslot 56E is located in slot position S7. As curve 80 indicates, coupling efficiency is greatest for the microslots located in the vicinity of positive antenna terminal 72. As the distance from positive antenna feed terminal 72 increases and the distance to ground antenna feed terminal 70 decreases, coupling efficiency tends to decrease.

Figure 7:
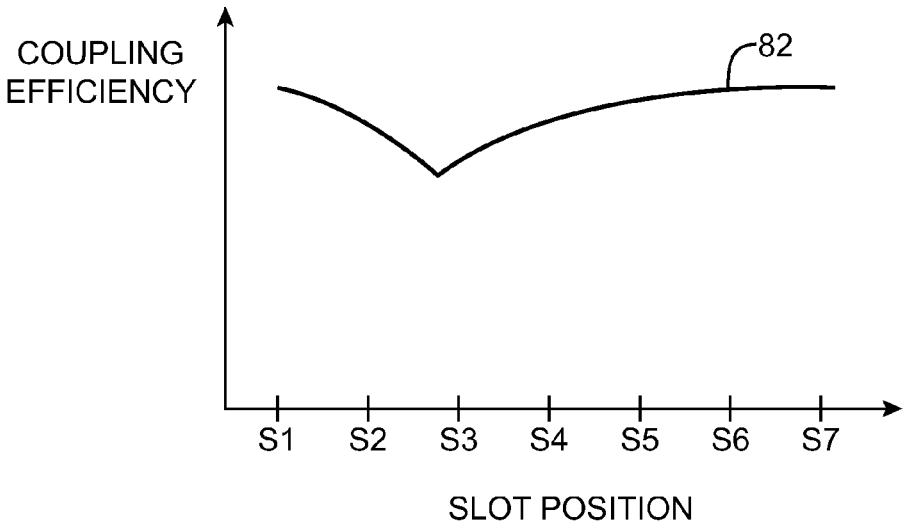
FIG. 7 is a graph showing how coupling efficiently may vary as a function of microslot position in a microslot antenna having an antenna feed arrangement of the type shown in FIG. 5 in accordance with an embodiment of the present invention.

In the graph of FIG. 7, antenna coupling efficiency is plotted as a function of slot position for an antenna feed arrangement of the type shown in FIG. 5. As with the arrangement of FIG. 3, microslot 54A is located in slot position S1, microslot 54B is located in slot position S2, microslot 56A is located in slot position S3, microslot 56B is located in slot position S4, microslot 56C is located in slot position S5, microslot 56D is located in slot position S6, and microslot 56E is located in slot position S7. Coupling efficiency for an antenna that is fed using a configuration of the type shown in FIG. 5 is represented by curve 82.

As curve 82 of FIG. 7 indicates, coupling efficiency is greatest for the microslots located in the vicinity of positive antenna terminal 72A and in the vicinity of positive antenna terminal 72B. As the distance from positive antenna feed terminals 72A and 72B increases and the distance to ground antenna feed terminal 70 decreases, coupling efficiency tends to decrease.

As the graphs of FIGS. 6 and 7 indicate, antenna feed configurations may affect coupling efficiency. Feed arrangements of the type shown in FIG. 5 may be result in coupling efficiencies that are more uniform than arrangements of the type shown in FIG. 3. Because the microslots of FIG. 5 are fed from a central position (e.g., using a ground feed terminal 70 that lies between the microslots), the maximum distance between the positive and ground feed terminals is less than in configurations of the type shown in FIG. 3. As a result, coupling efficiency drops less between the positive and ground feed terminals in center-feed arrangements of the type shown in FIG. 5 than in edge-feed arrangements of the type shown in FIG. 3. If desired, other microslot antenna feed arrangements may be used (e.g., using near-field coupling, using matching network 76, etc.). The antenna feed arrangements shown in FIGS. 3 and 5 are merely illustrative.

Figure 8:
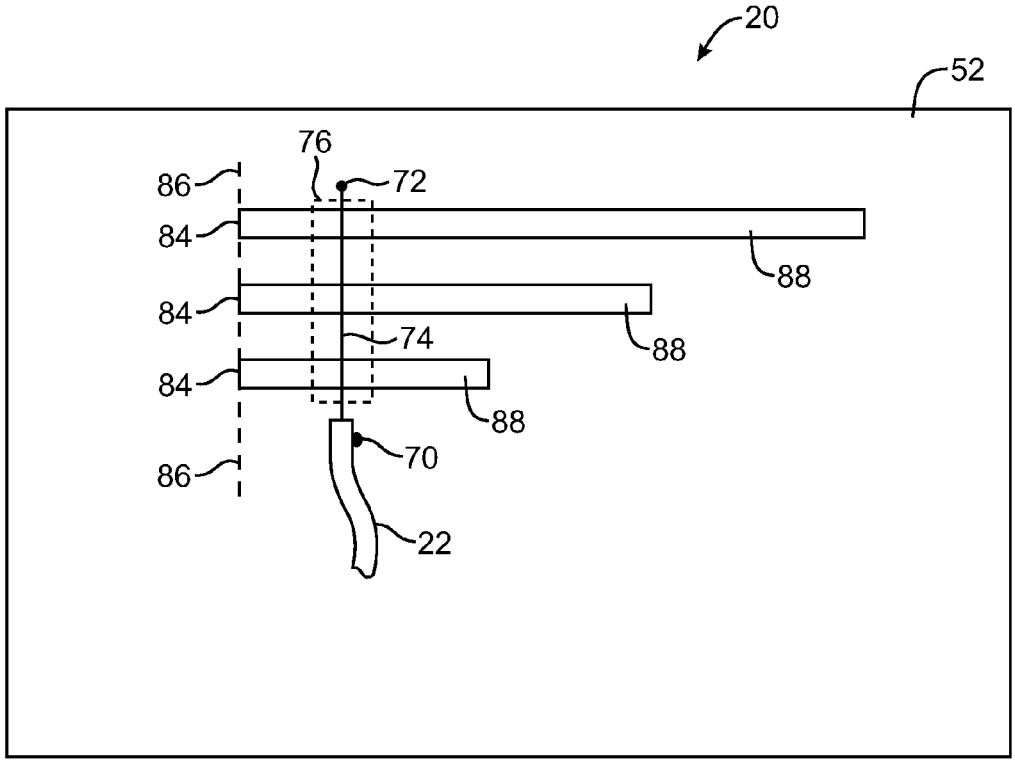
FIG. 8 is a top view of an illustrative microslot antenna having three microslots that are aligned along one end of the microslots in accordance with an embodiment of the present invention.

In the examples of FIGS. 3 and 5, microslots 54 and 56 are positioned so that the microslots are aligned along their lengths. With this type of configuration, each microslot is oriented so that a point midway along its length overlaps with signal conductor 74 (as an example). This is merely illustrative. For example, the microslots may be oriented so that some of the microslots are bridged by the antenna feed terminals at different points along their lengths (i.e., at points that are near to one of the ends of the microslots). As shown in FIG. 8, the microslots may be oriented so that ends 84 of microslots 88 are aligned along common axis 86. Other configurations (e.g., in which one or more of microslots 88 are horizontally shifted with respect to their positions in FIG. 8) may also be used.

Figure 9:
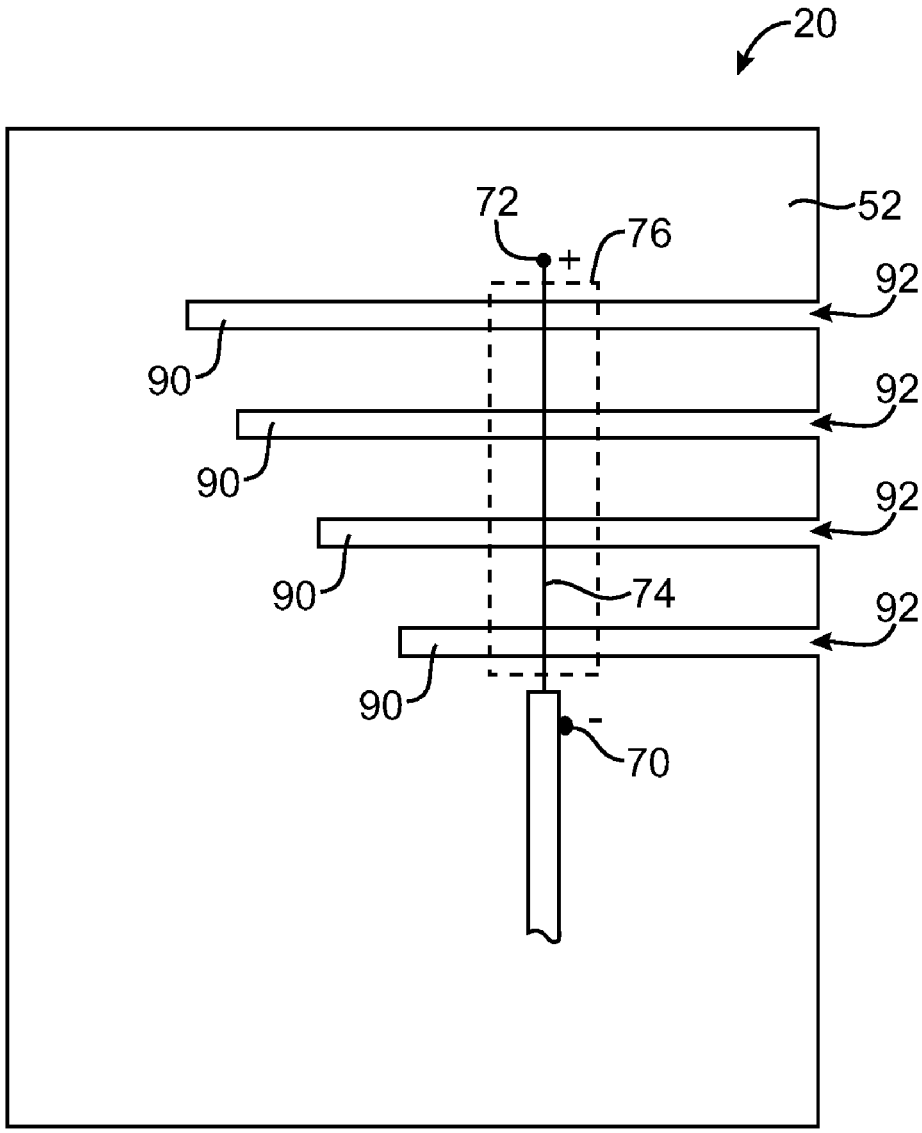
FIG. 9 is a top view of an illustrative microslot antenna having open ends in accordance with an embodiment of the present invention.

If desired, some or all of the microslots in antenna 20 may be open-ended slots. In the examples of FIGS. 3, 5, and 8, the microslots are close-ended slots that are surrounded by conductive portions of ground plane element 52. As shown in FIG. 9, open-ended slots 90 may have open ends 92. Open ends 92 may be filled with air, epoxy, plastic, or other dielectrics. Open-ended microslots and closed-ended microslots may be used together in the same antenna 20 or antenna 20 may be formed from only closed-ended microslots or only open-ended microslots. Antennas 20 such as antenna 20 of FIG. 9 may be fed using matching network 76 or other suitable feed arrangements. Feed terminals 72 and 70 may be placed at any suitable locations along the lengths of microslots 90. The arrangement of FIG. 9 is merely illustrative.

The foregoing is merely illustrative of the principles of this invention and various modifications can be made by those skilled in the art without departing from the scope and spirit of the invention.

What is claimed is:

1. An antenna comprising:

a ground plane element having portions comprising at least first and second dielectric-filled slots that serve as resonating elements for the antenna and that each have a width of less than 100 microns, wherein the at least first and second dielectric-filled slots are formed in a surface of the ground plane element and wherein the widths of the at least first and second dielectric-filled slots are dimensions of the at least first and second dielectric-filled slots that are coplanar with the surface of the ground plane element;

a ground terminal located between the at least first and second dielectric-filled slots and coupled to a ground conductor in a transmission line; and first and second antenna feed terminals coupled to a common signal conductor in the transmission line, wherein the first dielectric-filled slot is between the ground terminal and the first antenna feed terminal and wherein the second dielectric-filled slot is between the ground terminal and the second antenna feed terminal.

2. The antenna defined in claim 1 wherein the ground plane element portions are configured so that at least one of the at least first and second dielectric-filled slots has an open end.

3. The antenna defined in claim 1 wherein the at least first and second dielectric-filled slots form first and second groups of slots, wherein the first group of slots includes the first slot and covers a first communications band, and wherein the second group of slots includes the second slot and covers a second communications band.

4. The antenna defined in claim 1 wherein the at least first and second dielectric-filled slots form first and second groups of slots, wherein the first group of slots includes the first slot and covers a first communications band at 2.4 GHz, and wherein the second group of slots includes the second slot and covers a second communications band at 5.0 GHz.

5. The antenna defined in claim 1 wherein the at least first and second dielectric-filled slots form first and second groups of slots, wherein the first group of slots covers a first communications band at 2.4 GHz and contains at least the first slot and a third slot, and wherein the second group of slots covers a second communications band at 5.0 GHz and contains at least the second slot and a fourth slot.

6. The antenna defined in claim 5 wherein the first slot has a first length, the second slot has a second length, the third slot has a third length, and the fourth slot has a fourth lengths and wherein each of the first, second, third, and fourth lengths is unique.

7. The antenna defined in claim 1 wherein the at least first and second dielectric-filled slots form first and second groups of slots, wherein the first group of slots covers a first communications band at 2.4 GHz and contains at least the first slot and a third slot, wherein the second group of slots covers a second communications band at a second frequency and contains more than the second slot and a fourth slot, and wherein the second communications frequency is larger than the first communications frequency.

8. The antenna defined in claim 1 wherein each of the at least first and second dielectric-filled slots has a width that is less than 30 microns and wherein the at least first and second dielectric-filled slots each have a length of at least 10 mm.

9. An electronic device comprising:

transceiver circuitry;

a transmission line coupled to the transceiver circuitry;

a conductive case in which the transceiver circuitry and the transmission line are housed, wherein the conductive case has at least one dielectric-filled opening;

an antenna having a ground plane element formed from the conductive case and antenna resonating element formed from the at least dielectric-filled opening, wherein the at least opening comprises a microslot having a width of less than 100 microns, wherein the microslot formed in a surface of the conductive case, wherein the width of the microslot dimension of the microslot that coplanar with the surface of the conductive case, wherein the microslot comprises a first microslot, and wherein the antenna comprises a second microslot;

a ground terminal located between the first and second microslots and coupled to a ground conductor in the transmission line; and first and second antenna feed terminals coupled to a common signal conductor in the transmission line, wherein the first microslot is between the ground terminal and the first antenna feed terminal and wherein the second microslot is between the ground terminal and the second antenna feed terminal.

10. The electronic device defined in claim 9 further comprising epoxy that fills the dielectric-filled opening.

11. The electronic device defined in claim 9 wherein the electronic device comprises a portable electronic device, wherein the conductive case comprises a metal case, and wherein the antenna comprises a plurality of microslots formed in the conductive case.

12. The electronic device defined in claim 9 wherein the electronic device comprises a portable computer, wherein the conductive case comprises a conductive computer housing for the portable computer, wherein the antenna comprises a plurality of microslots formed in the conductive computer housing, and wherein each microslot has a width of less than 100 microns and a length of at least 10 mm.

13. The electronic device defined in claim 9 wherein the antenna comprises a plurality of microslots formed in the conductive case, and wherein each microslot has a width of less than 30 microns.

14. The electronic device defined in claim 9 wherein the electronic device comprises a portable electronic device, wherein the conductive case comprises a conductive housing for the portable electronic device, wherein the antenna comprises a plurality of microslots formed from openings in the conductive housing, wherein each microslot has a width of less than 100 microns and a length of at least 10 mm, wherein a first group of the microslots is configured to provide coverage for the antenna in a first communications band and wherein a second group of the microslots is configured to provide coverage for the antenna in a second communications band, wherein the first and second communications bands have respective center frequencies, wherein the center frequency of the second communications band is higher than the center frequency of the first communications band, and wherein each of the microslots in the second group has a length that is less than each of the microslots in the first group.

15. A portable electronic device antenna comprising:

a ground plane element formed from a conductive housing for the portable electronic device; and a plurality of microslots formed in the ground plane element, wherein each of the microslots has a width of less than 100 microns, wherein each of the microslots is formed in a surface of the ground plane element, wherein the width of each of the microslots is a dimension of that microslot that is coplanar with the surface of the ground plane element, wherein each microslot in the plurality of microslots has a length that is different from the lengths of all of the other microslots in the plurality of microslots, wherein a first plurality of the microslots are configured to provide antenna coverage in a first communications band, and wherein a second plurality of the microslots are configured to provide antenna coverage in a second communications band; and a ground terminal located between the first and second pluralities of microslots and coupled to a ground conductor in a transmission line; and first and second antenna feed terminals coupled to a common signal conductor in the transmission line, wherein the first plurality of microslots is between the ground terminal and the first antenna feed terminal and wherein the second plurality of microslots is between the ground terminal and the second antenna feed terminal.

16. The portable electronic device antenna defined in claim 15 wherein the first plurality of the microslots are configured to provide antenna coverage in a 2.4 GHz communications band and wherein the second plurality of the microslots are configured to provide antenna coverage in a 5.0 GHz communications band.

17. The portable electronic device antenna defined in claim 16 wherein the first plurality of microslots includes at least two microslots and wherein the second plurality of microslots includes at least four microslots.

18. The portable electronic device antenna defined in claim 15 wherein the first plurality of the microslots comprises first and second microslots, wherein the second plurality of the microslots comprises third and fourth microslots, wherein the first microslot is configured to provide antenna coverage in a first communications sub-band within the first communications band, wherein the second microslot is configured to provide antenna coverage in a second communications sub-band within the first communications band, wherein the third microslot is configured to provide antenna coverage in a third communications sub-band within the second communications band, and wherein the second microslot is configured to provide antenna coverage in a fourth communications sub-band within the second communications band.

* * * * *

UNITED STATES PATENT AND TRADEMARK OFFICE

CERTIFICATE OF CORRECTION

PATENT NO. : 8,373,610 B2
APPLICATION NO. : 11/958988
DATED : February 12, 2013
INVENTOR(S) : Bing Chiang et al.

It is certified that error appears in the above-identified patent and that said Letters Patent is hereby corrected as shown below:

In the Claims:

In claim 9, column 11, line 28 delete "and antenna resonating element" and insert
-- and an antenna resonating element --

In claim 9, column 11, line 29-30 delete "the at least opening comprises" and insert
-- the at least one opening comprises --

In claim 9, column 11, line 31 delete "wherein the microslot formed" and insert
-- wherein the microslot is formed --

In claim 9, column 11, line 33 delete "the microslot that coplanar" and insert
-- the microslot is coplanar --

Signed and Sealed this
Fourth Day of February, 2014

Michelle K. Lee

Michelle K. Lee
*Deputy Director of the United States Patent and Trademark Office*